United States Patent [19]

Tempelman

[11] Patent Number: 4,957,239

[45] Date of Patent: Sep. 18, 1990

[54] SPRAY HEAD FOR AN AEROSOL CONTAINER

[75] Inventor: Antonie P. Tempelman, Meeden, Netherlands

[73] Assignee: Mobacc B.V., Veendam, Netherlands

[21] Appl. No.: 352,015

[22] Filed: May 15, 1989

[30] Foreign Application Priority Data

May 16, 1988 [NL] Netherlands ..... 8801260

[51] Int. Cl.[5] ..... B65D 83/36

[52] U.S. Cl. ..... 239/117; 222/149; 239/464

[58] Field of Search ..... 222/148–149, 222/394, 402.1, 402.24, 402.12; 239/113, 117, 337, 464, 473, 492, 497, 533.1

[56] References Cited

U.S. PATENT DOCUMENTS

| | | | |
|---|---|---|---|
| 3,361,301 | 1/1968 | Meshberg | 222/149 |
| 3,545,682 | 12/1970 | Beard | 239/469 |
| 3,584,789 | 6/1971 | Traynor | 239/117 |
| 3,990,640 | 11/1976 | Laauwe | 239/533.1 |
| 4,182,496 | 1/1980 | Burke | 239/492 |
| 4,650,094 | 3/1987 | Werding | 222/55 |
| 4,723,725 | 2/1988 | Comment | 239/533.1 |

FOREIGN PATENT DOCUMENTS 2317969 2/1977 France .

*Primary Examiner*—Michael S. Huppert
*Attorney, Agent, or Firm*—Weingarten, Schurgin, Gagnebin & Hayes

[57] ABSTRACT

A spray head for a fluid dispenser comprises a connecting duct for sealingly receiving a delivery tube stub of an aerosol valve; a spray orifice; a chamber connecting the connecting duct and the orifice; a piston member disposed in the chamber and presenting a needle member cooperating with the orifice; and a spring urging the piston member to the orifice. The orifice is sealed by the end of the needle member in an inoperative position, and the piston member is arranged to move against the force exerted by the spring under the influence of an elevated pressure prevailing in the chamber, whereby the orifice is cleared by the needle member. To provide for improved atomization, according to the invention, the rear face of the piston member, which faces away from the needle member, defines a closed space which through a channel is in communication with a point located near the spray orifice for the injection of air from the closed space into the product stream to be sprayed through the spray orifice.

25 Claims, 5 Drawing Sheets

SPRAY HEAD FOR AN AEROSOL CONTAINER

Figure 1:
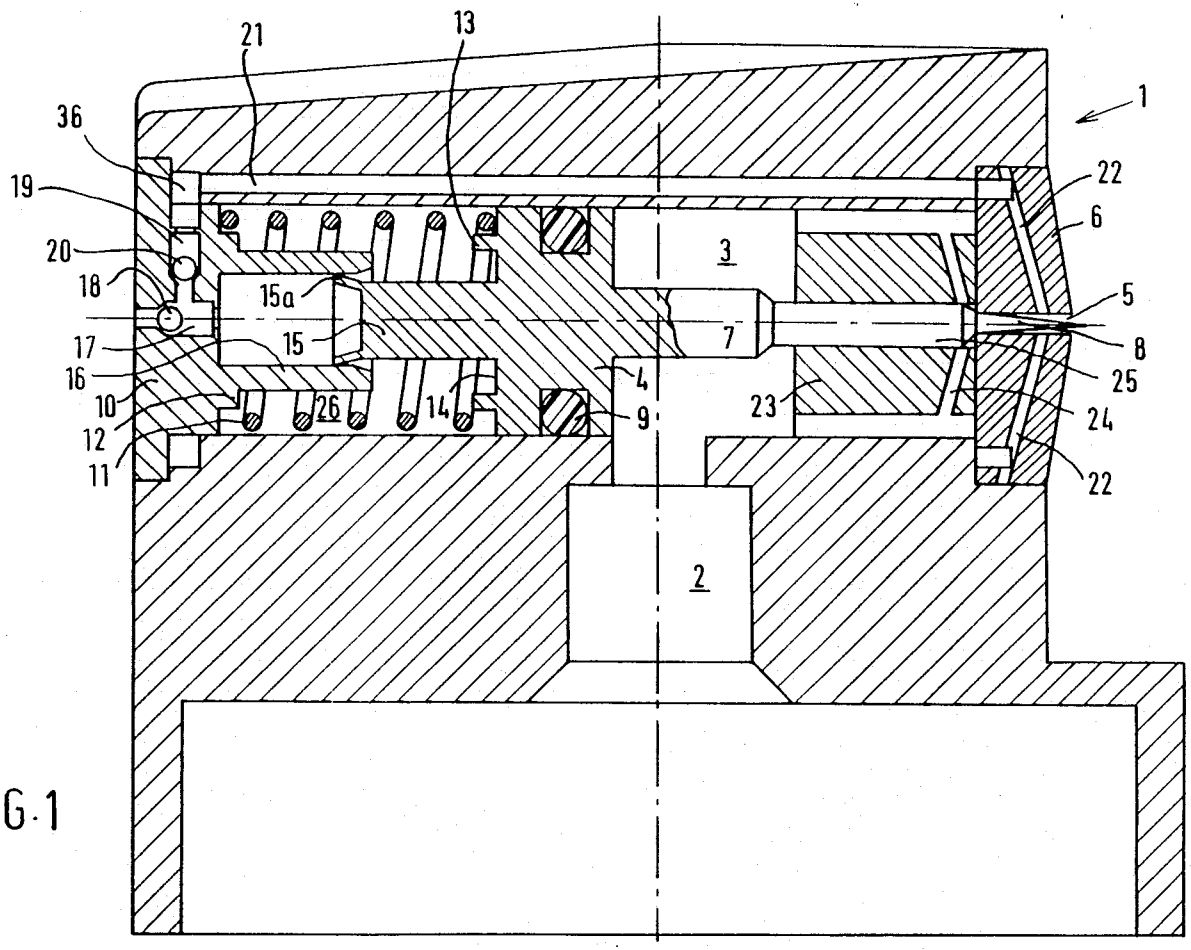

This invention relates to a spray head for an aerosol container, comprising a connecting duct for sealingly receiving a delivery tube stub of an aerosol valve; a spray orifice; a chamber connecting said connecting duct and said spray orifice; a piston member disposed in said chamber and presenting a needle member cooperating with said spray orifice; and spring means urging said piston member to said spray orifice, said spray orifice being sealed by the end of said needle member in an inoperative position, and the piston member being arranged to move against the force exerted by said spring means under the influence of an elevated pressure prevailing in said chamber, whereby the spray orifice is cleared by said needle member.

A spray head of this kind is disclosed in U.S. Pat. No. 4,182,496. Under the influence of the force exerted by the spring means on the piston member, the needle member cooperating with the spray orifice seals the spray orifice so long as the spray head is not operated. As soon as the spray head is operated with the finger, in the usual way, an open connection is formed, also in the usual way, between the interior of the container on which the spray head is mounted and the connecting duct and the chamber of the spray head. As a result the pressure in the chamber rises, and the piston member is moved away from the spray orifice against the force exerted by the spring means. The spray orifice is thus cleared by the needle member, and the product can exit from the container.

After termination of a spray operation, product residues remaining behind in the connecting duct and the chamber are effectively sealed from the outside air by the needle member cooperating with the spray orifice, and consequently cannot dry up and render the spray cannister unsuitable for use. It is only between the needle member and the walls of the spray orifice that a minor quantity of product could be deposited, as a result of which the needle member could become stuck. The small contact area between the needle member and the spray orifice, however, ensures that the force exerted on the piston member when the spray head is operated is sufficiently large for the needle member to be pulled out of the spray orifice even then.

A spray head of this kind is particularly suitable for use in environmentally friendly low-propellant fluid dispensers such as aerosol containers. Unlike conventional aerosol containers, in low-propellant spray cannisters the propellant is not permitted to leave the container. Consequently, the spray head of the dispenser must not be flushed with propellant in the usual way by holding the container upside down and operating the spray head with the finger. Indeed, in many low-propellant spray cannisters, as described, for example, in our Netherlands patent application No. 8800774, this is impossible, because means are provided to ensure that the propellant cannot exit from the container in any position the container occupies.

A problem which does occur in low-propellant spray cannisters is that the spray dispensed is rather wet, which means that there is insufficient atomization. This problem can be solved to a certain extent by using a swirl chamber which is passed by the product being sprayed just before it reaches the spray orifice. Such a swirl chamber is shown in U.S. Pat. No. 4,182,496, but practice has shown that, even when a swirl chamber is used, in which the product is, so to say, mixed with gas, the resulting spray is still too wet with many products, such as paint.

It is an object of the present invention to provide a solution for the problem outlined above and to provide, generally, an effective spray head for a fluid dispenser, which is particularly suitable for low-propellant aerosol containers.

According to the present invention, for this purpose, there is provided a spray head of the kind defined above, which is characterized in that the rear face of the piston member, which faces away from the needle member, defines at least one substantially closed space which through at least one channel is in communication with at least one point, located in or near the spray orifice, for the injection of air from said closed space into the product stream to be sprayed through said spray orifice.

Figure 3:
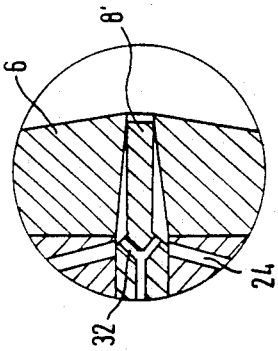
Figure 2:
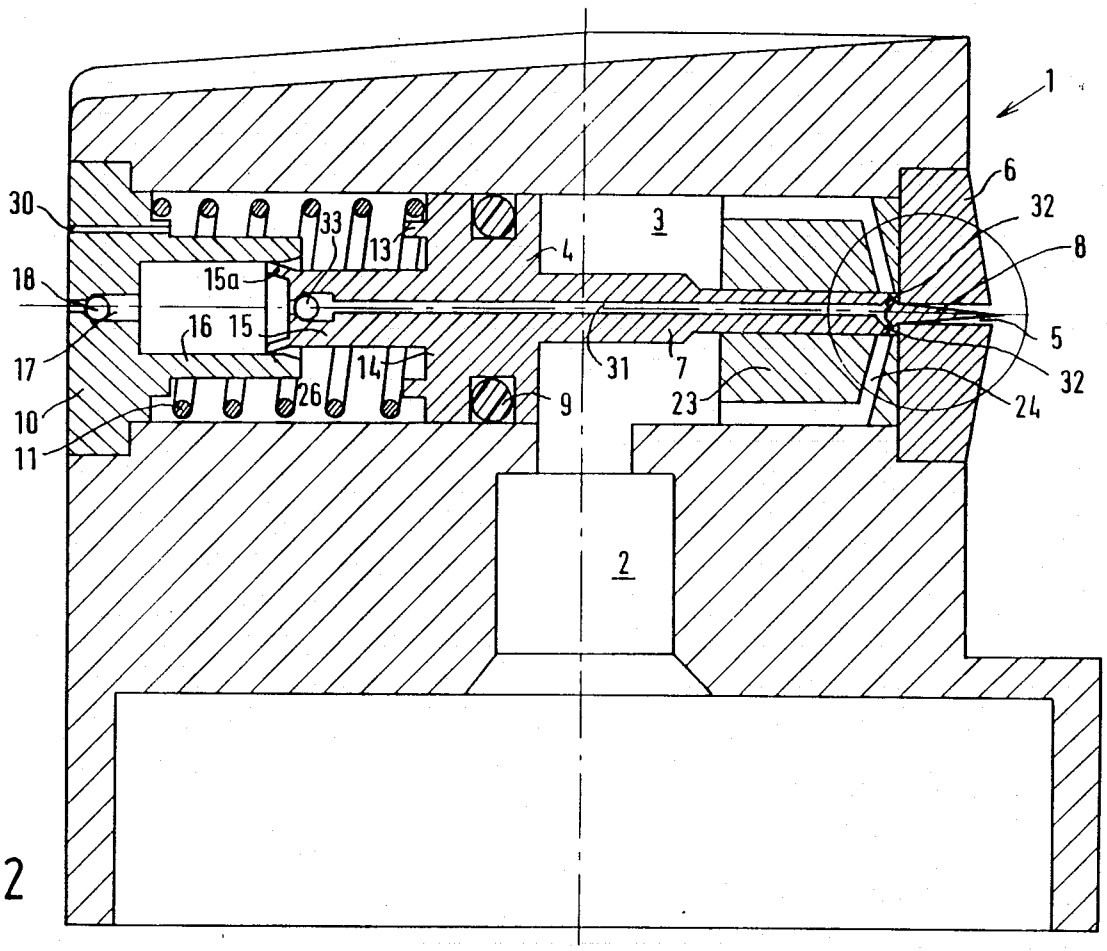
Figure 4:
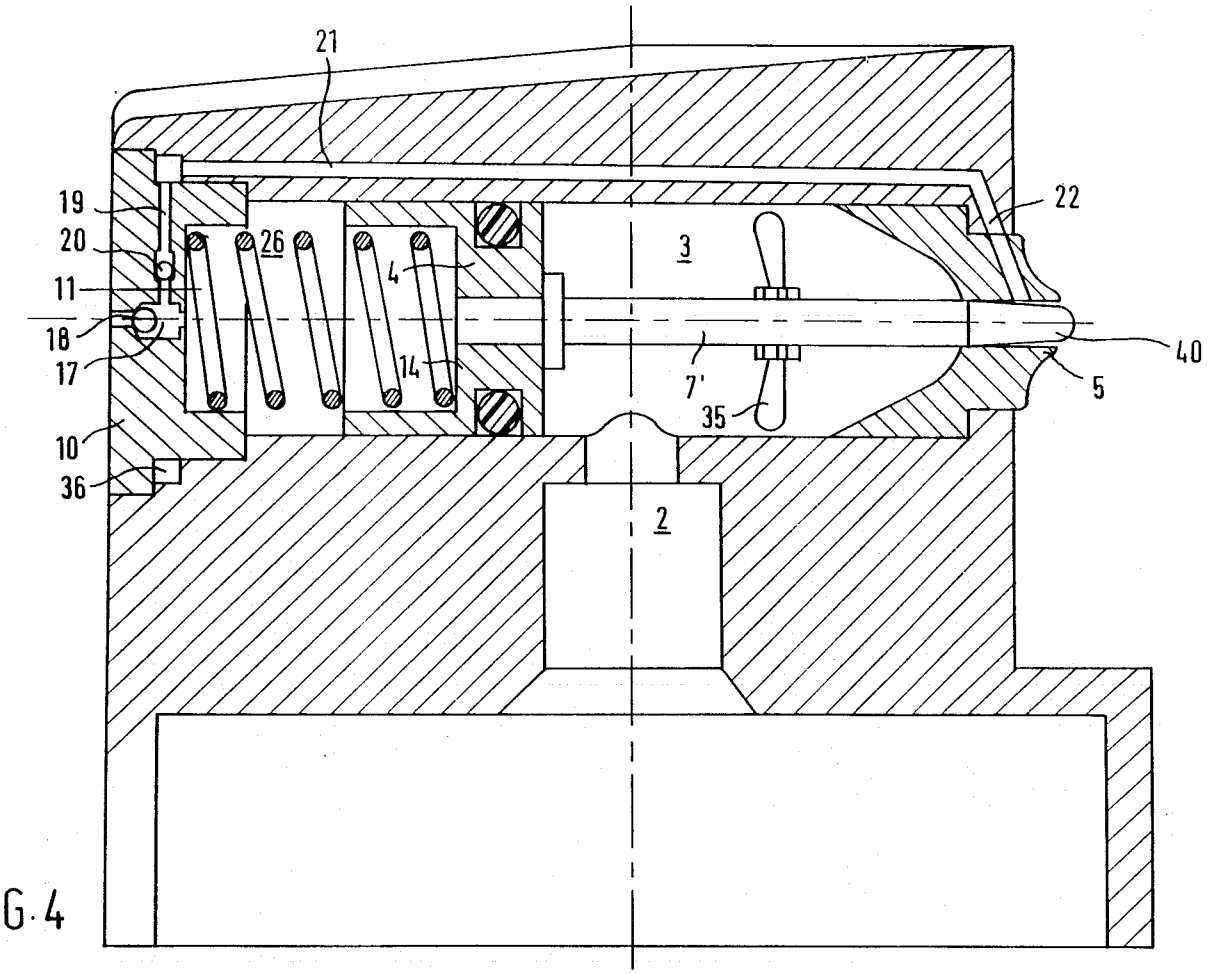
Figure 5:
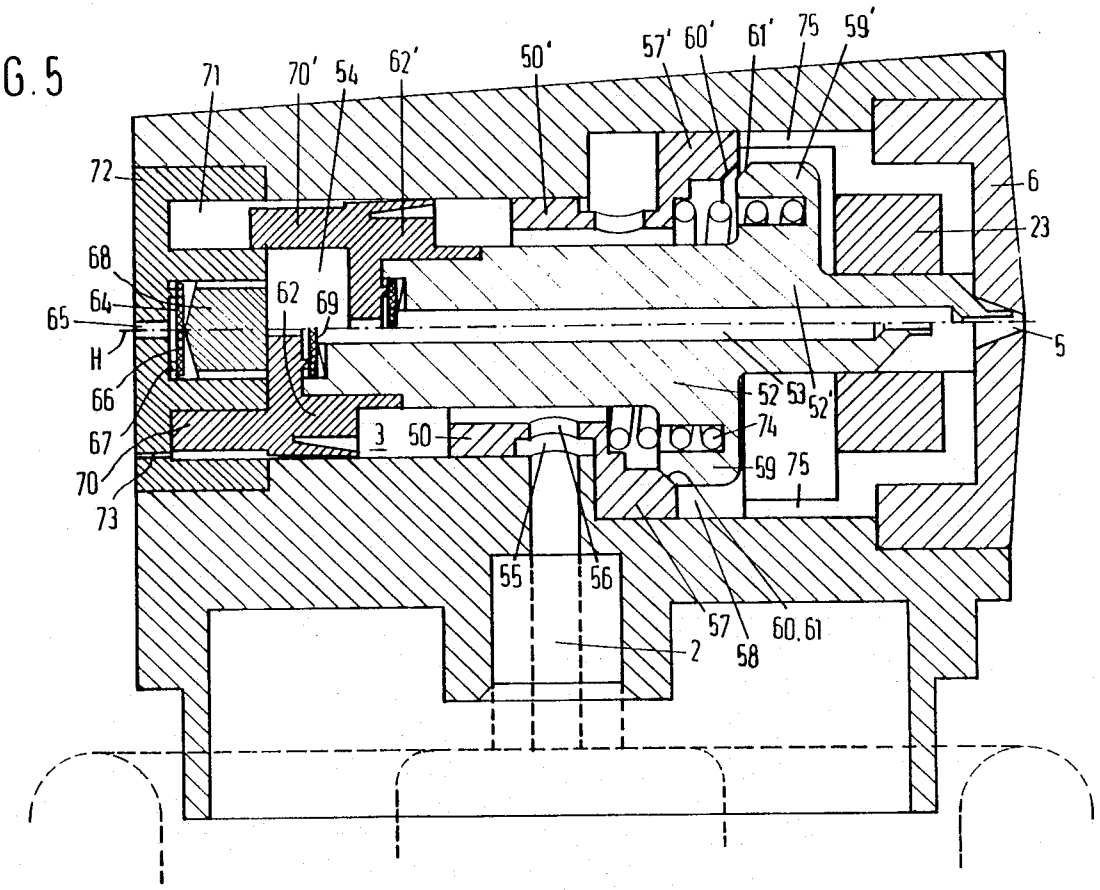
Figure 6:
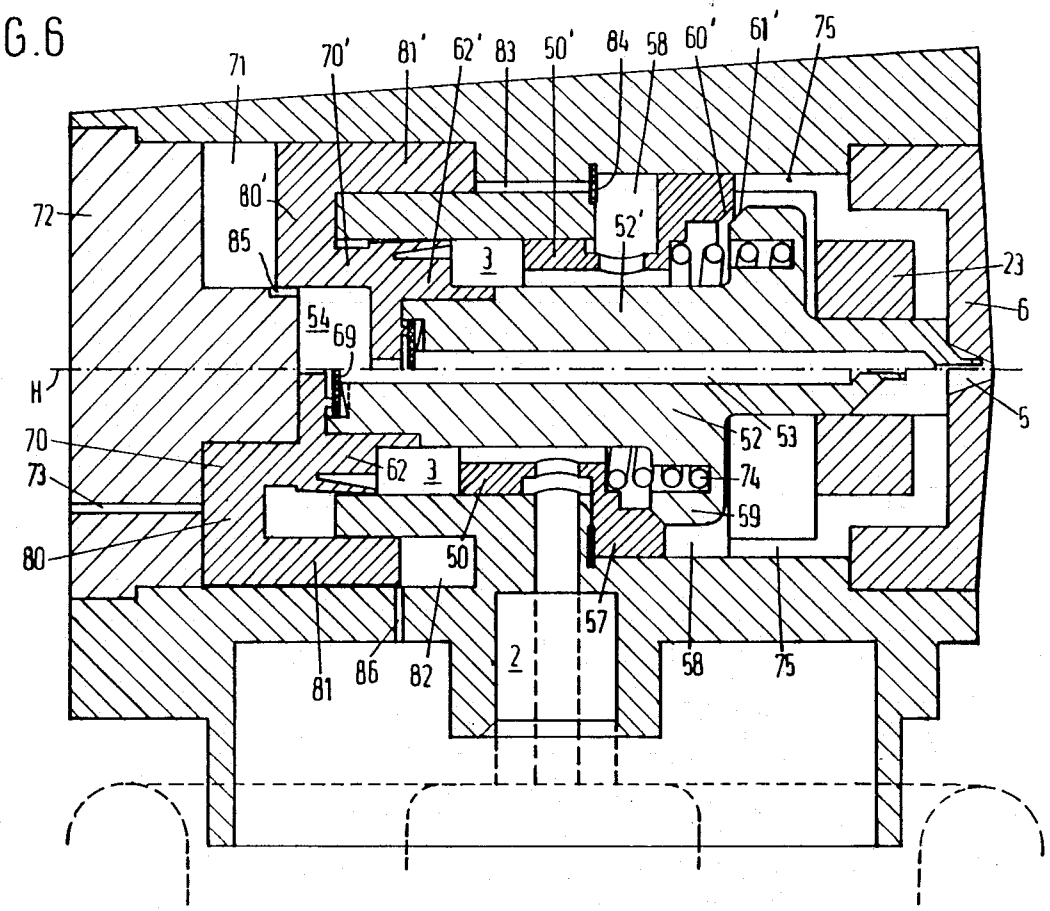

Some embodiments of the invention will now be described, by way of example, with reference to the accompanying drawings. In said drawings, FIG. 1 diagrammatically shows a cross-sectional view of a first embodiment of a spray head according to this invention;

FIG. 2 diagrammatically shows a cross-sectional view of a second embodiment of a spray head according to this invention;

FIG. 3 diagrammatically shows a variant of a detail of FIG. 1 and FIG. 2;

FIG. 4 shows a possible modification of the embodiments of FIG. 1 and FIG. 2;

FIG. 5 diagrammatically shows an example of a variant of a spray head according to this invention; and FIG. 6 diagrammatically shows a modification of the embodiment of FIG. 5.

FIG. 1 diagrammatically shows, in cross-sectional view, a first embodiment of a spray head according to this invention. The spray head has a connecting duct 2 capable of receiving a conventional delivery tube stub of a fluid dispenser such as an aerosol container. The connecting duct terminates in a chamber 3 housing a piston member 4 near one end thereof. Disposed at the other end of chamber 3 is a spray orifice 5 which in this example is formed in a separate insert 6, which seals that end of the chamber.

Extending from piston body 4 is a generally needle-shaped member 7 which, at least in the inoperative position as shown, extends with its free end 8 into spray orifice 5 and seals the same. In the embodiment shown, the free end 8 of the needle member is tapered, and the spray orifice 5 is a straight bore. Other embodiments are shown in FIG. 3 and FIG. 4.

Piston body 4 is provided with a sealing element 9, for example, an O ring, which sealingly cooperates with the wall of chamber 3.

The piston member is biased in the direction of the spray orifice 5 by spring means. In the embodiment shown, for this purpose, a helical spring 11 is provided between a rear end wall 10 of the chamber and the rear face 14 of the piston member away from the spray orifice. In this example, the rear end wall is also formed as a loose insert, fixed in some suitable manner. The helical spring is positioned by a shoulder 12 of the rear end wall 10 and by a circular ridge 13 or a number of projections on the rear surface of the piston member. Extending from the rear face 14 of the piston member, in the direction of the rear end wall 10, is a piston 15 of smaller diameter than chamber 3. Piston 15 extends into a corresponding hollow cylinder secured to, or formed integrally with, the rear end wall 10. Piston 15 and cylinder 16 are so positioned relatively to each other that the piston can move from the inoperative position as shown in the direction of the rear end wall 10. Cylinder 16 is further connected to the outside air through a bore 17 with a non-return valve 18. Furthermore, cylinder 16 is connected through a cross duct 19, with a non-return valve 20, to a channel 21. Channel 21 extends parallel to the axis of chamber 3 into insert 6 and is in communication with spray orifice 5 through one or more ancillary channels 22 in the insert. In this example, the cross-duct 19 terminates in the axial bore 17, but other configurations are conceivable. For example, the cross-duct may be directly connected to cylinder 16.

Also, a plurality of cross-ducts may be used, with a plurality of channels leading to the spray orifice.

In the example shown, there is further used a swirling member 23 comprising a spin chamber 24 terminating in a central bore 25 in the swirling member adjacent to the spray orifice 5. The needle member 7 extends through the central bore into the swirling member.

The operation of the spray head described is as follows. As soon as the spray head, mounted on an aerosol container, is depressed, the aerosol valve, not shown, is opened, and a certain pressure is built up in chamber 3 as a result of the pressure prevailing in the aerosol container. As soon as the pressure built up is high enough to move piston member 4 against the force of spring 11, and possibly also against a retaining force acting on needle end 8 and caused by product residues in spray orifice 5, in the direction of the rear end wall 10 of the chamber, the needle end 8 clears spray orifice 5. The product can then be sprayed through connecting duct 2, chamber 3, spin chamber 23, if present, and spray orifice 5.

While the piston member is moving to the rear end wall 10, piston 15 penetrates into cylinder 16. The air contained in cylinder 16 cannot pass non-return valve 18, but can pass valve 20 and thus reach spray orifice 5 through cross duct channel 19, channel 21 and ancillary channels 22.

Accordingly, in this way, air is injected into the product stream flowing through the spray orifice during spraying. As a result the product is more effectively atomized and a drier spray is obtained.

When the spray orifice 5 has been cleared by the needle end, the pressure in chamber 3 falls, so that shortly thereafter spring 13 causes the needle end to move in the direction of the spray orifice again and to seal it. At the same time, through bore 17 and non-return valve 18, outside air is drawn into cylinder 16. Also, immediately after the sealing of the spray orifice the pressure in chamber 3 is increased again, and the above process is repeated, at least so long as the spray head remains depressed.

Accordingly, the needle end performs an oscillating movement, with air being injected into the product stream with each stroke. The frequency of the oscillating movement is such, with a suitable choice of spring tension and piston diameters, that the intermittent operation is not perceivable as the dispenser is used.

It is noted that, if desired, the space 26 housing spring 11 can be in communication with the outside air through an open bore. Such an open bore is not shown in FIG. 1, but shown, by way of example, at 30 in FIG. 2.

It is further noted that, in principle, the function of cylinder 16 and piston 15 can be performed by chamber 26 in cooperation with the rear surface 14 of piston member 4. In that case, therefore, air is injected into the spray orifice from chamber 26. Open bore 30 can then be done without or should be provided with a one-way valve.

Such a variant is shown diagrammatically, and by way of example, in the accompanying FIG. 4, which will be described hereinafter.

FIG. 2 shows a variant of FIG. 1, in which an integral air injection channel extends through the piston member and the needle member to the vicinity of the spray orifice. In the embodiment of FIG. 2, the air injection channel 31 is extending axially through piston member 4 from cylinder 16 to the vicinity of spray orifice 5, which channel branches at needle end 8 into two or more short cross-channels 32 extending diagonally forward and terminating in the product stream. At the other end of channel 31, a one-way valve 33 is provided, which only opens when the pressure in cylinder 16 is higher than that in channel 31, i.e., when piston 15 moves to the rear end wall 10.

For the rest, the operation of the embodiment shown in FIG. 2 is the same as the operation of the example shown in FIG. 1.

It is noted that, in the embodiments described, needle end 8 is tapered, while spray orifice 5 is a straight bore. This means that the passage area cleared by the needle end is less as the pressure within chamber 3 is lower. With a smaller aperture, however, the rate of through flow is relatively increased, as a result of which the effect of the lower pressure is at least in part compensated for. Accordingly, with a suitable design of the needle end it is possible to provide a product exit velocity substantially independent of the pressure within chamber 3 and hence independent of the instantaneous degree of filling of the aerosol container.

FIG. 3 shows a right-cylindrical needle end 8' cooperating with a tapered spray orifice 5'. With this construction, too, the cross-sectional area of the effective spray orifice decreases with decreasing pressure within chamber 3, and the above effect is achieved. Various other constructions in which the passage becomes smaller according as the needle end extends further into the spray orifice are conceivable.

FIG. 4 shows an embodiment with a spray orifice 5 formed by a straight bore, and a tapered, but blunt needle end 40. Furthermore, in the embodiment of FIG. 4 there is not used a separate piston 15 with associated cylinder 16, but air is directly injected into the product stream from chamber 26 through ducts 17 and, 19, and through channels 21. The injection ducts and channels may alternatively extend through the needle member 7' proper, as indicated in FIG. 2.

In the embodiment shown in FIG. 4, a blade wheel 35 is mounted around the needle member in chamber 3, which blade wheel may be fixed or rotatable by a fluid flowing past it. The use of such a blade wheel promotes effective atomization of the product and a good spray pattern.

Various modifications of the embodiments described are possible. Thus in all of the embodiments shown, both a front and a rear insert have been used. In principle, however, an insert at one of the sides would be all that is needed. In the embodiments of FIG. 2 and FIG. 4, for example, this could be the front insert. In the embodiment of FIG. 1, both inserts are provided with cross-ducts, so that, from the point of view of production technique, it is simplest to use separate inserts both at the front and the rear. However, this is not strictly necessary.

Similarly, the use of an annular chamber 36 cleared by the rear insert 10 in the embodiments of FIG. 1 and FIG. 4 and forming a connection with channel 21 is advantageous from the point of view of production technique, but not essential.

Furthermore, various combinations of features shown in the figures are possible, for example, the use of both an integral air injection channel 31 and a channel 21 and the like.

With regard to piston 15, it is noted that the sealing of the piston 15 relative to cylinder 16 can advantageously be accomplished by giving the end of the piston facing the cylinder a cup-shaped design with a slightly flaring resilient skirt 15*a*. This rim can act as a kind of one-way valve, so that during a movement to the left (for example in FIG. 2) the rim is effectively sealed, but during a movement to the right air is drawn into cylinder 16 from chamber 26 by way of skirt 15*a*, which then recedes. Chamber 26 then again draws in air through open bore 30. In that case, one-valve 18 can be omitted.

FIG. 5 shows a variant of the embodiments described hereinbefore. In the embodiment of FIG. 5, an additional slide valve 50 is used, which is arranged to cooperate with a piston member 52 provided with a needle member 51 and can seal or clear the connection between connecting duct 2 and chamber 3. Piston member 52 and needle member 51 are provided with an axial channel 53, similar to the embodiment of FIG. 3, which channel, during a rearward movement of piston member 52 (i.e., to the left as viewed in the figure) can supply air to spray orifice 5 from a chamber 54 formed behind the piston member. In FIG. 5, the slide valve and the piston member are shown in different positions above and below centre line H. The movable parts shown above the centre line are designated by accented reference numerals.

The inoperative position of piston member 52 is designated by 52' above centre line H. Slide valve 50, on the other hand, is shown in the inoperative position below centre line H, with a position in which it seals a duct being designated by 50' above centre line H. Slide valve 50 has a rear portion with a relatively small diameter and with a circumferential groove 55 and one or more radial bores 56 which can clear or seal the connecting duct 2. Slide valve 52 has further a forward portion 57 with a larger diameter, disposed in a correspondingly wider portion 58 of chamber 3, in which it can move to and fro. Piston member 52 has a portion 59 of a relatively large diameter disposed within portion 58 of chamber 3. Portion 57 of the valve and portion 59 of the piston member are both provided with cooperating sealing edges or other sealing means capable of providing a gas-tight seal between members 57 and 59 if these parts are in contact with each other. This last situation is shown in the part of FIG. 5 below centre line H. The sealing means are in this case beveled edges 60,61, which act as a valve seat each for the other.

The rear portion 62 of piston member 52 acts as a piston and has a diameter equal to the diameter of chamber 3. Formed behind piston portion 62 is chamber 54. Chamber 54 is again in communication with the outside air through a one-way valve 63 and a bore 65. The one-way valve comprises a flexible washer 66 which near its circumference lies on the annular rim 67 and is further centrally supported by a conical body 68. When there is an under-pressure in chamber 54, the washer is flexed towards the conical body, so that a gap is formed between rim 67 and the peripheral region of the washer, and air can flow to the chamber. In the case of an overpressure in chamber 54, the washer is firmly pressed into contact with rim 67 and the valve thus formed is closed. A similar valve 69, which, however, is opened in case there is overpressure in chamber 54, is provided in axial channel 53 in the piston member and the needle member.

In the embodiment shown, the piston portion 62 further has an annular flange 70 extending rearwardly and fitting a corresponding annular recess 70 in a rear insert 72 of the spray head. The annular recess is permanently sealed from chambers 3 and 54 by flange 70, and is preferably connected to the outside air through a lower bore 73. The annular recess is an additional guide for the piston member.

The operation of the embodiments shown in FIG. 5 is as follows. In the inoperative position, the piston member is in the position designated by 5', 59', 62', 70' while the slide valve is in the position designated by 50,57. When the spray head, mounted on an aerosol container, is depressed, the pressure in chamber 3 is raised. As the spray orifice 5 is sealed by the needle member, the increased pressure in chamber 3 causes the piston member to move to the left, through piston portion 62, against the pressure of a spring 74, provided between slide valve 50 and the large-diameter portion 59 of the piston member. During this rearward movement, the product is sprayed from the container through the space between valve 50 and portion 59, swirl chamber 23 and spray orifice 5. At the same time, air is admixed from chamber 54, which air reaches the spray orifice and/or swirl chamber 23 through the axial channel 53. This operation is similar to the operation of the embodiments described before.

As soon as valve seats 60,61 are in contact with each other, as shown in the drawing below centre line H, slide valve 50 and portion 59 of enlarged diameter form, as it were, one piston, on which the pressure prevailing in chamber 3 acts. As the surface area of this combined piston exceeds that of the piston portion 62, the piston member along with the slide valve subsequently moves to the right until the forward part 57 of the slide valve abuts against stops 75 in the forward chamber portion 58, as indicated at 57'. In that position connecting duct 2 is sealed. Piston member 52 moves further to the right, aided by spring 74, until the needle member seals spray orifice 5. Valve seats 60,61 are then out of contact with each other, as shown at 60', 61', and the same gas pressure prevails on opposite sides of slide valve 50. Spring 73, which is not yet entirely expanded, then moves the slide valve to the left into its starting position, whereafter the cycle described can be repeated so long as the spray head is being depressed. In the manner described, the piston member is reciprocated at a high frequency, with air being supplied to the product being sprayed at each stroke. This results in a dry spray, and promotes effective atomization.

The accompanying FIG. 6 shows a variant of the embodiment shown in FIG. 5, and mainly differs from it in that the piston member is provided with an additional annular piston portion, which during the forward stroke of the piston member injects air into the product being sprayed, through means provided for the purpose. In FIG. 6, corresponding parts are designated by the same reference numerals as used in FIG. 5. Furthermore, similarly to FIG. 5, FIG. 6 shows different positions of the moving parts above and below the longitudinal centre line H.

In the embodiment of FIG. 6, the annular flange 70 at the rear of piston member 52 is provided with a broadened rear portion 80, which at its outer edge has a second annular flange 81 extending forwardly. Chamber 71 is enlarged to accommodate the broadened portion 80. The second annular flange 81 forms an annular piston which can reciprocate in a fitting annular chamber 82. Chamber 82 is in communication with chamber 58 through a number of ducts 83 formed in the body of the spray head, so that during a forward movement of the piston member (i.e. to the right as viewed in FIG. 6) air is propelled from chamber 82 to chamber 58, which also contains the product to be sprayed. Ducts 83 are provided with one-way valves 84 shown diagrammatically. Preferably, a plurality of ducts 83 are provided in radial distribution.

In this example, chamber 54 is connected through a recess 85 to chamber 71 when the piston member is in a forward position. Chamber 71 is, in turn, in communication with the outside air through one or more bores 73, so that chamber 54 is filled with air with each forward movement of the piston member. Similarly chamber 82 is in communication with the outside air, directly or indirectly, through vertical duct 86, which is cleared in the rearward position of the annular piston 81 vertical duct. Duct 86 is in this example operated by the annular piston, but could alternatively be provided with a one-way valve which is opened during a rearward movement of the annular piston and sealed during a forward movement.

I claim:

1. In a spray head for a fluid dispenser, comprising a body having a connecting duct for sealingly receiving a delivery tube stub of an aerosol valve; a spray orifice; a chamber in said body connecting said connecting duct and said spray orifice; a piston member disposed in said chamber and presenting a needle member cooperating with said spray orifice; and spring means urging said piston member to said spray orifice, said spray orifice being sealed by the end of said needle member in an inoperative position, and the piston member being arranged to move against the force exerted by said spring means under the influence of an elevated pressure prevailing in said chamber, whereby the spray orifice is cleared by said needle member, the improvement which comprises that the rear face of the piston member, which faces away from the needle member, defines a wall of at least one substantially closed space which through at least one channel is in communication with at least one point, located in or near the spray orifice, for the injection of air from said closed space into the product stream to be sprayed through said spray orifice.

2. A spray head as claimed in claim 1, characterized by said at least one channel extending from the rear face of the piston member axially through said piston member and having at least one mouth near the free end of the needle body.

3. A spray head as claimed in claim 2, characterized in that the needle member has an edge extending obliquely rearwardly relative to the spray orifice, which edge contains said at least one mouth of said at least one channel.

4. A spray head as claimed in claim 1, characterized by said at least one channel extending from said closed space through the material of the spray head surrounding the chamber.

5. A spray head as claimed in claim 1, characterized by the provision of a piston on the rear face of said piston member, which piston cooperates with a corresponding cylinder.

6. A spray head as claimed in claim 5, characterized in that said piston is formed integrally with the piston member.

7. A spray head as claimed in claim 1, characterized in that the spring means include a compression spring disposed within said closed space.

8. A spray head as claimed in claim 1, characterized in that said at least one channel includes a one-way valve.

9. A spray head as claimed in claim 1, characterized in that the closed space is closed by an insert at the end located opposite the rear face of the piston member.

10. A spray head as claimed in claim 9, characterized in that said insert includes at least one radial duct forming part of said at least one channel.

11. A spray head as claimed in claim 9, characterized in that said insert includes an axial duct which through a one-way valve forms a connection between the closed space and the outside air.

12. A spray head as claimed in claim 10, characterized in that the insert and the body of the spray head together clear an annular chamber to which said at least one radial duct and said at least one channel are connected.

13. A spray head as claimed in claim 5, characterized in that the cylinder is formed on an insert sealing the closed space.

14. A spray head as claimed in claim 5, characterized in that the part of the closed space surrounding the piston and the cylinder is in communication with the outside air through an open bore.

15. A spray head as claimed in claim 14, characterized in that said open bore is a bore formed in an insert sealing said closed space.

16. A spray head as claimed in claim 1, characterized by a swirling member provided in the vicinity of the spray orifice.

17. A spray head as claimed in claim 16, characterized in that the swirling member is a rotatable blade wheel provided around the needle member.

18. A spray as claimed in claim 1, characterized in that the end of the needle member and the spray orifice are so shaped that when the pressure in the chamber decreases the part of the spray orifice cleared by the needle end is decreased.

19. A spray head as claimed in claim 1, characterized in that the spray orifice is an axial duct provided in a forward insert which seals the chamber.

20. A spray head as claimed in claim 19, characterized in that the forward insert includes at least one cross-duct communicating with said at least one channel.

21. A spray head as claimed in claim 14, characterized in that the piston is provided with a sealing skirt capable of functioning as a one-way valve and arranged to permit air to flow to the cylinder when the piston member moves towards the spray orifice.

22. A spray head as claimed in claim 21, characterized in that the sealing skirt is a cup-shaped member formed on the piston and including a flaring rim facing the cylinder.

23. A spray head as claimed in claim 1, characterized in that the chamber comprises a rear cylindrical portion in which the piston part of the piston member is active, and a forward widened chamber portion into which extends a portion of the piston member having an enlarged diameter; that a slide valve is provided between the rear cylindrical portion of the chamber and the portion of the piston member having an enlarged diameter, which slide valve seals or clears the connecting duct, and extends coaxially around the piston member and has a broadened portion extending into said widened chamber portion to sealingly cooperate with the wall of the widened chamber portion; that the portion of the piston member having an enlarged diameter can move relative to the slide valve between a sealing position and a position clearing a passage between the broadened portion of the slide valve and the portion of the piston member having an enlarged diameter; and that at least a portion of the spring means is arranged between the part of the piston member having an enlarged diameter and the slide valve.

24. A spray head as claimed in claim 23, characterized in that the piston member carries an additional annular piston which extends into a corresponding annular chamber and during a movement of the piston member in the direction of the spray orifice reduces the volume of said annular chamber, said annular chamber communicating through at least one duct, provided with a one-way valve, with the chamber connecting the connecting duct and the spray orifice.

25. A spray head as claimed in claim 24, characterized in that the annular extra piston has a cylindrical shape, and defines a skirt forming the extra piston, said skirt extending from an annular flange connected to the rear surface of the piston member into the annular chamber in the direction of the spray orifice.

* * * * *

UNITED STATES PATENT AND TRADEMARK OFFICE

CERTIFICATE OF CORRECTION

PATENT NO. : 4,957,239

DATED : September 18, 1990

INVENTOR(S) : Antonie P. Tempelman

It is certified that error appears in the above-identified patent and that said Letters Patent is hereby corrected as shown below:

Column 3, line 42, "cross duct channel 19," should read --cross duct 19,--.

Column 3, line 42, "channel 21" should read --and channel 21--.

Column 4, line 53, "channels 21" should read --channels 21 and 22--.

Column 6, line 22, "5'," should read --52',--.

Column 7, line 29-30, "piston 81 vertical duct. Duct 86" should read --piston 81. Vertical duct 86--.

Signed and Sealed this

Twenty-fifth Day of August, 1992

*Attest:*

*Attesting Officer*

DOUGLAS B. COMER

*Acting Commissioner of Patents and Trademarks*